United States Patent [19]

Fischer

[11] 4,217,481

[45] Aug. 12, 1980

[54] COOKING APPLIANCE WITH SEVERAL ELECTRIC COOKING ZONES

[76] Inventor: Karl Fischer, Am Gaensberg 23, 7519 Oberderdingen, Fed. Rep. of Germany

[21] Appl. No.: 938,747

[22] Filed: Aug. 31, 1978

[30] Foreign Application Priority Data

Sep. 3, 1977 [DE] Fed. Rep. of Germany ..... 2739760

[51] Int. Cl.[2] ..... H05B 1/02

[52] U.S. Cl. ..... 219/450; 219/476; 219/477

[58] Field of Search ..... 219/445–447, 219/449, 450, 455, 458, 460, 461, 463–467, 472, 476–480, 394, 218; 236/20 A, 21 B, 32

[56] References Cited

U.S. PATENT DOCUMENTS

| | | | |
|---|---|---|---|
| 1,903,477 | 4/1933 | Rolfson | 219/480 |
| 2,379,504 | 7/1945 | Thompson | 219/417 |
| 2,399,423 | 4/1946 | Bletz | 219/449 |
| 2,764,665 | 9/1956 | Walkoe | 219/450 |
| 2,823,290 | 2/1958 | Warner | 219/449 |
| 2,949,525 | 8/1960 | Dunn | 219/415 |
| 3,313,919 | 4/1967 | Richardson et al. | 219/445 |
| 3,345,497 | 10/1967 | Porteous | 219/417 |
| 3,632,982 | 1/1972 | Linger | 219/479 |

FOREIGN PATENT DOCUMENTS

| | | | |
|---|---|---|---|
| 973247 | 8/1975 | Canada | 219/447 |

*Primary Examiner*—Roy N. Envall, Jr.
*Assistant Examiner*—Bernard Roskoski
*Attorney, Agent, or Firm*—Steele, Gould & Fried

[57] ABSTRACT

A surface-unit cooking appliance comprising a plurality of electric hot plates of the same type, each of the hot plates having a temperature regulator and each of the regulators having a temperature sensor for sensing the temperature of a cooking vessel or a product being cooked, at least one of the hot plates being disposed in each of first and second surface cooking zones, the first zone being designed for boiling water-containing media, the at least one temperature regulator therein being designed and constructed with a temperature control range limited to a maximum temperature of 150° C. (300° F.) at the temperature sensor, and the second zone being designed for roasting, the at least one temperature regulator therein being designed and constructed with a temperature control range limited to a maximum temperature above 220° C. (430° F.) at the temperature sensor.

4 Claims, 2 Drawing Figures

FIG. 1
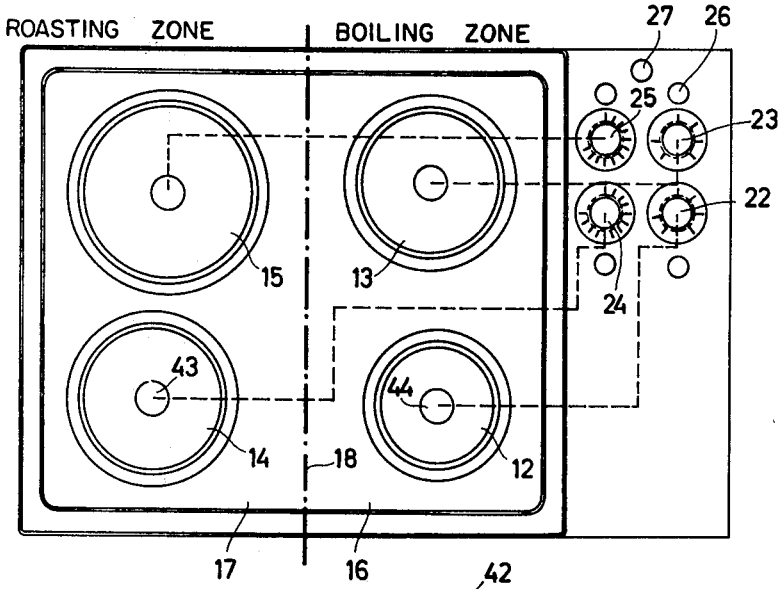
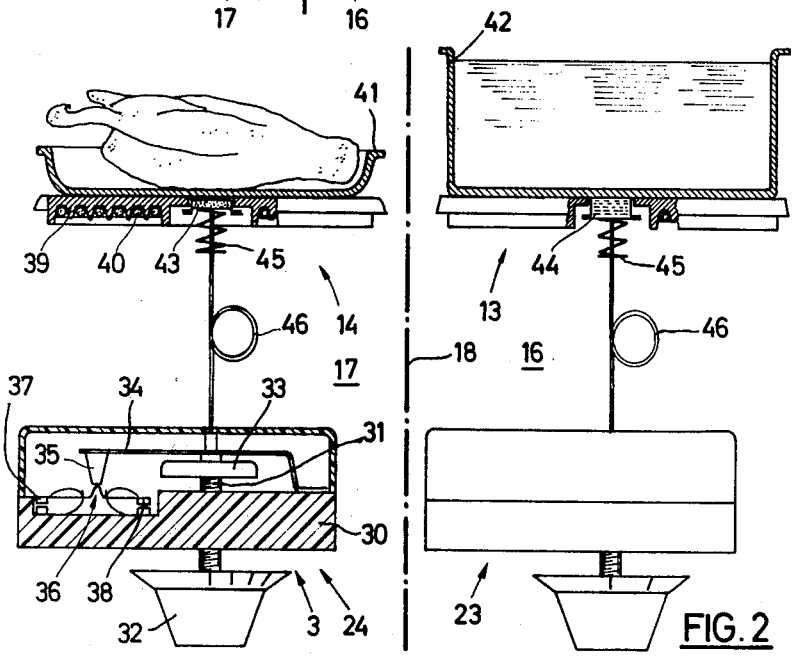
FIG. 2

COOKING APPLIANCE WITH SEVERAL ELECTRIC COOKING ZONES

BACKGROUND OF THE INVENTION

The invention relates to a cooker with a plurality of electric hot plates with thermostats or temperature regulators having temperature sensors which sense the temperature of the cooking vessel or the product being cooked.

When correctly operated such electric hot plates, known as automatic hot plates, are ideal for most boiling and roasting processes. When the temperature regulators are constructed as two-circuit regulators, i.e. two different power stages of the hot plate can be switched off by the thermostat at temperatures which follow one another relatively closely, such hot plates are extremely adaptable and guarantee an optimum rapid heating, while adhering to the set temperature in an optimum manner. However, frequently such hot plates are incorrectly operated, in that housewives accustomed to stepwise or continuous power control set the hot plates much too high, because they think that boiling will take place much more rapidly. The product being cooked is then heated to an excessive extent, which can lead to overcooking or burning. Particularly in the case of hot plates with a closed surface, which naturally have a certain heat storage capacity, it takes a time until the excessive temperature reached has declined again. As a result, even with correct operation the efficiency of the automatic hot plates is impaired. However, it would be incorrect to reduce the capacity of the hot plates, because then it would take unnecessarily long to bring to the boil.

SUMMARY OF THE INVENTION

The object of the present invention is to provide a cooker of the type indicated hereinbefore in which the possibility of incorrect operation is reduced, thereby permitting energy saving.

According to the invention this problem is solved in that the cooker has two zones, one (roasting zone) having at least one electric hot plate intended mainly for roasting, while the other zone (boiling zone) has at least one electric hot plate intended mainly for boiling water-containing media, and that the thermostats are constructed in such a way that the control range of each thermostat of each electric hot plate of the boiling zone limits the maximum temperature at the sensor to below 150° C., while each thermostat for the roasting zone permits maximum temperatures at the sensor of about 220° C.

If the two zones are correspondingly marked it is no longer possible for the housewife to set excessive temperatures when working in the boiling zone. In addition, the complete temperature control in the boiling zone is made more sensitive, so that very low temperatures of for example 40° C. can be set for warming meals. However, the hot plates in the roasting zone still permit very high temperatures, so that it is also possible to perform processes requiring high temperatures. This limitation of the maximum temperatures in the boiling zone can be performed without difficulty because in a normal household it is extremely unlikely that for example more than two hot plates are required for roasting processes or other processes requiring high temperatures. Tests have shown that normal hot plates are used for approximately 90% of their total working time for warming and boiling processes, while they are only used for about 10% for roasting processes. Thus, for example on a normal cooker it is completely realistic to subdivide into two hot plates in the boiling zone and two hot plates in the roasting zone and this contributes to a considerable energy saving.

BRIEF DESCRIPTION OF THE DRAWINGS

The invention will be described in greater detail hereinafter relative to non-limitative embodiments and with reference to the attached drawings, which show:

FIG. 1: a plan view of a cooker with its adjusting knobs.

FIG. 2: a diagrammatic section through two electric hot plates and the associated thermostats.

DETAILED DESCRIPTION OF THE PREFERRED EMBODIMENT

The cooker 11 shown in FIG. 1, a surface-unit cooking appliance has four hot plates 12, 13, 14, 15 a small hot plate 12 with a diameter of for example, 115 mm, and an installed capacity of 1,000 W; two medium-sized hot plates 13, 14 of, for example, a diameter of 145 mm and an installed capacity of 1,500 W; and a large hot plate with a diameter of 180 mm and an installed capacity of 2,000 W. Hot plates 12 and 13 are in the boiling zone 16, whilst hot plates 14 and 15 belong to the roasting zone 17. The two zones are indicated separately by a dot-dash line 18 in FIG. 1. This separation can be made readily apparent in various ways, for example by a different colouring or structure of the cooker surface in the two zones, by a continuous physical line, an inscription, differing structure of the sensor boxes, hot plates or flush rings, etc. In the present embodiment the four thermostats 22, 23, 24, 25 for the four hot plates are arranged in corresponding manner to the hot plates in an area of the cooker surface following the actual cooking depression. In accordance with the arrangement of the two zones 16, 17 the right-hand thermostats 22, 23 are associated with the two hot plates of the boiling zone and the left-hand thermostats 23, 25 are associated with the roasting zone. As indicated the division of the knobs for the roasting zone is carried out in the conventional manner as a function of the temperature (from 1 to 12), while in the boiling zone a division from 1 to 6 is sufficient for the operating states. The setable temperatures behave accordingly. The thermostats for the boiling zone are set in such a way that the maximum temperature of the cooking vessel or sensor does not rise above 150° C., while the thermostats for the roasting zone permit a sensor or vessel temperature of above 220° C. The preferred setting ranges are 40° to 140° C. for the boiling zone, i.e. from the warming range to the boiling range with a certain reliability and 80° to 250° or 270° C. for the roasting zone. This corresponds to a hot plate temperature of 320° to 350° C., which on the one hand can well be withstood by the hot plate and on the other ensures that all possible roasting or frying processes can still be performed.

FIG. 1 also shows that a pilot light 26 is associated with each thermostat 22 to 25, said pilot lights being provided in addition to the overall pilot light 27 for the operation of any hot plate on the cooker, to indicate when a hot plate is actually switched on by its thermostat. By differing coloring of the pilot lights a subdivision into boiling zone and roasting zone can be indicated, in that for example the pilot lights in the boiling zone light up blue and those in the roasting zone light up red.

The subdivision of the boiling and roasting zones can be of an arbitrary nature. However, the boiling zone is preferably positioned in the most accessible area of the cooker because, as indicated hereinbefore, boiling processes are those which are most frequently performed. It is also wise to provide small and medium-sized hot plates in the boiling zone and the generally single large hot plate in the roasting zone, because this best takes account of all operating states.

FIG. 2 diagrammatically shows the preferred construction of the hot plates and their thermostats in both zones. A particular advantage is that the thermostats in both zones can be made identical, despite their differing operation. The present thermostat is for example described in detail in DOS 25 40 499 and has a casing 30 in which is mounted a setting screw spindle 31 permitting the adjustment of the thermostat by means of a knob 32. It presses onto an expansion box 33 filled with an expansion liquid and is fixed to a pivotable transmission lever 34, which via a contact piece 35 acts on a snap switch 36 with two pairs of contacts 37, 38 controlling the two heating resistors of the hot plate.

The hot plates 13, 14 shown diagrammatically in section are identical and have a cast iron hot plate body 39 in which the heating resistors 40 are embedded in slots. Cooking vessels and specifically a roasting tin 41 in roasting zone 17 and a saucepan 42 in boiling zone 16 are placed on the hot plates. On the bottom thereof temperature sensors 43, 44 arranged in the unheated central area of each hot plate are pressed on by springs 45 and connected via in each case a capillary tube 46 with the expansion box 33 of the thermostat. The only difference between the thermostats is in the filling volume of the temperature sensors. The temperature sensor 43 for the roasting zone has a smaller filling volume, while the temperature sensor 44 for the boiling zone has a larger filling volume. As a result of being filled with more expansion liquid the thermostat 23 for the boiling zone has a greater action on the temperature, leading to a lower temperature range which is wider than for the roasting zone.

Numerous variants to the represented and described embodiment are possible within the scope of the invention. Thus, for example different types of thermostats can be used, e.g. electronic thermostats operating with electrical resistance sensors, or other types of mechanical temperature regulators. When using electronic thermostats it is also particularly easy to vary the control range by modifying the basic setting or corresponding adaptation of the temperature sensors. Whereas in the present case a particularly accurate and sensitive control with temperature sensors pressed onto the bottom of the saucepan has been described, the invention can also be used in the case of sensors which sense the temperature of the cooking vessel or its content in other ways, for example temperature sensors fitted in the centre of the hot plate, but closed by a metal diaphragm, so that they do not sense the heat of the bottom of the saucepan by contact, but instead by convective or radiant heat transmission.

Thus, the present invention provides a cooker which, without restricting its versatility greatly contributes to the saving of power. In addition, by following the simple rule of performing the cooking processes mainly in the boiling zone it is ensured that incorrect operation will not lead to overcooking or burning of the product being cooked. There is also a greater sensitivity of control in the warming range, leading to an improved operating behaviour.

The invention is not limited to the embodiments described and represented hereinbefore and various modifications can be made thereto without passing beyond the scope of the invention.

I claim:

1. A surface-unit cooking appliance comprising a plurality of electric hot plates of the same type, each of the hot plates having a temperature regulator and each of the regulators having a temperature sensor for sensing the temperature of a cooking vessel or a product being cooked, at least one of the hot plates being disposed in each of first and second surface cooking zones, the first zone being designed for boiling water-containing media, the at least one temperature regulator in the first zone being designed and constructed with a temperature control range limited to a maximum temperature of 150° C. at the temperature sensor, and the second zone being designed for roasting, the at least one temperature regulator in the second zone being designed and constructed with a temperature control range limited to a maximum temperature above 220° C. at the temperature sensor.

2. A cooking appliance according to claim 1, wherein the temperature sensors are filled with an expansion liquid, and wherein, for otherwise identical regulator construction for the two zones, the volume of each boiling zone temperature sensor is larger than the volume of each roasting zone sensor.

3. A cooking appliance according to claims 1 or 2, wherein the control range of each roasting zone regulator is 80° to 250° C. and the control range of each boiling zone regulator is 40° to 140° C.

4. A cooking appliance according to claim 1, wherein the boiling zone is located in that part of the appliance providing easiest accessibility for a user.

* * * * *